US009350069B2

(12) United States Patent
Pascolini et al.

(10) Patent No.: US 9,350,069 B2
(45) Date of Patent: May 24, 2016

(54) ANTENNA WITH SWITCHABLE INDUCTOR LOW-BAND TUNING

(75) Inventors: Mattia Pascolini, Campbell, CA (US); Robert W. Schlub, Cupertino, CA (US); Nanbo Jin, Sunnyvale, CA (US); Matthew A. Mow, Los Altos, CA (US); Hongfei Hu, Santa Clara, CA (US); Joshua G. Nickel, San Jose, CA (US)

(73) Assignee: Apple Inc., Cupertino, CA (US)

( * ) Notice: Subject to any disclaimer, the term of this patent is extended or adjusted under 35 U.S.C. 154(b) by 470 days.

(21) Appl. No.: 13/343,657

(22) Filed: Jan. 4, 2012

(65) Prior Publication Data

US 2013/0169490 A1 Jul. 4, 2013

(51) Int. Cl.

| | |
|---|---|
| ***H01Q 1/24*** | (2006.01) |
| ***H01Q 5/00*** | (2015.01) |
| ***H01Q 5/357*** | (2015.01) |

(52) U.S. Cl.

CPC ..... *H01Q 1/243* (2013.01); *H01Q 5/357* (2015.01)

(58) Field of Classification Search

CPC ..... H01Q 5/314; H01Q 5/321; H01Q 5/328; H01Q 5/357; H01Q 1/243

USPC ..... 343/702

See application file for complete search history.

(56) References Cited

U.S. PATENT DOCUMENTS

| | | | |
|---|---|---|---|
| 2,324,462 | A | 7/1943 | Leeds et al. |
| 2,942,263 | A | 6/1960 | Baldwin |
| 3,394,373 | A | 7/1968 | Makrancy |
| 3,736,591 | A | 5/1973 | Rennels et al. |
| 4,123,756 | A | 10/1978 | Nagata et al. |
| 4,349,840 | A | 9/1982 | Henderson |

(Continued)

FOREIGN PATENT DOCUMENTS

| | | |
|---|---|---|
| CN | 1745500 | 3/2006 |
| CN | 1764077 | 4/2006 |

(Continued)

OTHER PUBLICATIONS

"The ARRL Antenna Book", The American Radio Relay League, 1988, pp. 2-24 to 2-25.*

(Continued)

*Primary Examiner* — Hoang V Nguyen
*Assistant Examiner* — Daniel J Munoz
(74) *Attorney, Agent, or Firm* — Treyz Law Group, P.C.; G. Victor Treyz; Michael H. Lyons

(57) ABSTRACT

Electronic devices may be provided that contain wireless communications circuitry. The wireless communications circuitry may include radio-frequency transceiver circuitry and antennas. An antenna may be formed from an antenna resonating element arm and an antenna ground. The antenna resonating element arm may have a shorter portion that resonates at higher communications band frequencies and a longer portion that resonates at lower communications band frequencies. A short circuit branch may be coupled between the shorter portion of the antenna resonating element arm and the antenna ground. A series-connected inductor and switch may be coupled between the longer portion of the antenna resonating element arm and the antenna ground. An antenna feed branch may be coupled between the antenna resonating element arm and the antenna ground at a location that is between the short circuit branch and the series-connected inductor and switch.

26 Claims, 9 Drawing Sheets

(56) References Cited

U.S. PATENT DOCUMENTS 4,380,011 A 4/1983 Torres et al.
4,518,965 A 5/1985 Hidaka
4,617,571 A 10/1986 Choquer et al.
4,625,212 A 11/1986 Oda et al.
4,879,755 A 11/1989 Stolarczyk et al.
4,893,131 A 1/1990 Smith et al.
4,894,663 A 1/1990 Urbish
4,980,694 A 12/1990 Hines
5,021,010 A 6/1991 Wright
5,023,621 A 6/1991 Ushiyama et al.
5,041,838 A 8/1991 Liimatainen
5,048,118 A 9/1991 Brooks
5,061,943 A 10/1991 Rammos
5,105,396 A 4/1992 Ganter et al.
5,159,707 A 10/1992 Mogi et al.
5,381,387 A 1/1995 Blonder et al.
5,408,241 A 4/1995 Shattuck
5,465,098 A 11/1995 Fujisawa et al.
5,473,252 A 12/1995 Renz et al.
5,561,437 A 10/1996 Phillips
5,585,810 A * 12/1996 Tsuru et al. ..... 343/745
5,627,552 A 5/1997 Farrar et al.
5,754,143 A 5/1998 Warnagiris
5,768,691 A 6/1998 Matero et al.
5,798,984 A 8/1998 Koch
5,812,066 A 9/1998 Terk et al.
6,011,699 A 1/2000 Murray
6,014,113 A 1/2000 Orchard et al.
6,021,317 A 2/2000 Irvin
6,097,345 A 8/2000 Walton
6,171,138 B1 1/2001 Lefebvre et al.
6,269,054 B1 7/2001 Truini
6,282,433 B1 8/2001 Holshouser
6,337,662 B1 1/2002 Cassel
6,339,400 B1 1/2002 Flint et al.
6,518,929 B1 2/2003 Gilmore
6,560,443 B1 5/2003 Vaisanen et al.
6,606,063 B1 8/2003 Merenda
6,622,031 B1 9/2003 McCleary
6,670,923 B1 12/2003 Kadambi et al.
6,741,214 B1 5/2004 Kadambi et al.
6,747,601 B2 6/2004 Boyle
6,762,723 B2 7/2004 Nallo
6,812,898 B2 11/2004 Doubt et al.
6,853,605 B2 2/2005 Fujisawa et al.
6,856,294 B2 2/2005 Kadambi et al.
6,885,880 B1 4/2005 Ali
6,894,647 B2 5/2005 Jenwatanavel
6,933,897 B2 8/2005 Asano et al.
6,968,508 B2 11/2005 Lucaci
6,980,154 B2 12/2005 Vance et al.
7,027,838 B2 4/2006 Zhou et al.
7,035,170 B2 4/2006 Narayanaswami et al.
7,084,814 B2 8/2006 Chen et al.
7,116,276 B2 10/2006 Lee
7,119,747 B2 10/2006 Lin et al.
7,123,208 B2 10/2006 Baliarda et al.
7,132,987 B1 11/2006 Olsson et al.
7,155,178 B2 12/2006 Chang et al.
7,164,387 B2 1/2007 Sievenpiper
7,167,090 B1 1/2007 Mandal et al.
7,176,842 B2 2/2007 Bettren et al.
7,212,161 B2 5/2007 Chen et al.
7,215,283 B2 5/2007 Boyle
7,215,600 B1 5/2007 DeRosa
7,239,889 B2 7/2007 Saari et al.
7,250,910 B2 7/2007 Yoshikawa et al.
7,260,424 B2 8/2007 Schmidt
7,271,769 B2 9/2007 Asano et al.
7,340,286 B2 3/2008 Korva et al.
7,348,928 B2 3/2008 Ma et al.
7,372,406 B2 5/2008 Shiotsu et al.
7,408,517 B1 8/2008 Poilasne et al.
7,420,511 B2 * 9/2008 Oshiyama et al. ..... 343/700 MS
7,551,142 B1 6/2009 Zhang et al.
7,595,759 B2 9/2009 Schlub et al.
7,612,725 B2 11/2009 Hill et al.
7,619,574 B1 11/2009 West
7,623,079 B2 11/2009 Hayashi
7,652,629 B2 1/2010 Teshima
7,671,693 B2 3/2010 Brobston et al.
7,671,804 B2 3/2010 Zhang et al.
7,696,932 B2 4/2010 Desclos et al.
7,714,790 B1 5/2010 Feldstein et al.
7,768,461 B2 8/2010 Cheng et al.
7,768,462 B2 8/2010 Zhang et al.
7,768,468 B2 8/2010 Gustafson et al.
7,869,830 B2 1/2011 Hartenstein et al.
7,876,274 B2 1/2011 Hobson et al.
7,884,769 B2 2/2011 Boyle
7,889,139 B2 2/2011 Hobson et al.
7,936,307 B2 5/2011 Pang et al.
8,009,110 B2 8/2011 Teng et al.
8,040,656 B2 10/2011 Park et al.
8,054,240 B2 11/2011 Honda
8,102,319 B2 1/2012 Schlub et al.
8,102,321 B2 1/2012 Chiang et al.
8,106,836 B2 1/2012 Hill et al.
8,169,373 B2 5/2012 Schlub et al.
8,204,446 B2 6/2012 Scheer et al.
8,227,700 B2 7/2012 Kim
8,233,950 B2 7/2012 Hobson et al.
8,421,702 B2 4/2013 Desclos et al.
8,665,164 B2 3/2014 Hill et al.
2001/0043514 A1 11/2001 Kita
2002/0126236 A1 9/2002 Hiratsuka
2003/0107518 A1 6/2003 Li et al.
2003/0117900 A1 6/2003 Fujisawa et al.
2004/0008146 A1 1/2004 Ikegaya et al.
2004/0017318 A1 1/2004 Annabi
2004/0041734 A1 3/2004 Shiotsu et al.
2004/0056808 A1 3/2004 Jenwatanavet
2004/0090377 A1 5/2004 Dai et al.
2004/0116157 A1 * 6/2004 Vance et al. ..... 455/562.1
2004/0145521 A1 7/2004 Hebron et al.
2004/0207559 A1 * 10/2004 Milosavljevic ..... 343/702
2004/0222926 A1 * 11/2004 Kontogeorgakis et al. ... 343/702
2004/0227678 A1 11/2004 Sievenpiper
2004/0257283 A1 12/2004 Asano et al.
2004/0263411 A1 12/2004 Fabrega-Sanchez et al.
2005/0073462 A1 4/2005 Lin
2005/0085204 A1 4/2005 Poilasne et al.
2006/0055606 A1 3/2006 Boyle
2006/0097941 A1 5/2006 Bettner et al.
2006/0114159 A1 6/2006 Yoshikawa et al.
2006/0125703 A1 6/2006 Ma et al.
2006/0139211 A1 * 6/2006 Vance et al. ..... 343/700 MS
2007/0146218 A1 6/2007 Turner et al.
2007/0149145 A1 6/2007 Chang et al.
2007/0176843 A1 8/2007 Qureshi
2007/0182658 A1 8/2007 Ozden
2007/0200766 A1 8/2007 McKinzie et al.
2007/0216590 A1 9/2007 Montgomery et al.
2007/0218853 A1 9/2007 Yu
2007/0222697 A1 9/2007 Caimi et al.
2007/0224948 A1 9/2007 Hartenstein et al.
2007/0229376 A1 10/2007 Desclos et al.
2007/0268191 A1 * 11/2007 Ishizuka et al. ..... 343/702
2008/0081581 A1 4/2008 Rofougaran
2008/0100514 A1 5/2008 Abdul-Gaffoor et al.
2008/0143613 A1 6/2008 Iwai et al.
2008/0150811 A1 6/2008 Honda et al.
2008/0218291 A1 9/2008 Zhu et al.
2008/0266199 A1 10/2008 Milosavljevic et al.
2008/0316115 A1 12/2008 Hill et al.
2009/0051604 A1 2/2009 Zhang et al.
2009/0081963 A1 3/2009 Boren
2009/0128428 A1 5/2009 Ishizuka et al.
2009/0153407 A1 6/2009 Zhang et al.
2009/0153412 A1 6/2009 Chiang et al.
2009/0179811 A1 7/2009 Chou
2009/0180403 A1 7/2009 Tudosoiu
2009/0185325 A1 7/2009 Park et al.
2009/0256758 A1 10/2009 Schlub et al.

(56) References Cited

U.S. PATENT DOCUMENTS

| | | | | |
|---|---|---|---|---|
| 2009/0256759 | A1 | 10/2009 | Hill et al. | |
| 2010/0007564 | A1 | 1/2010 | Hill et al. | |
| 2010/0022203 | A1 | 1/2010 | Bonnet et al. | |
| 2010/0053002 | A1 | 3/2010 | Wojack et al. | |
| 2010/0060421 | A1 | 3/2010 | Chang et al. | |
| 2010/0060529 | A1 | 3/2010 | Schlub et al. | |
| 2010/0109968 | A1 | 5/2010 | Suzuki et al. | |
| 2010/0123632 | A1 | 5/2010 | Hill et al. | |
| 2010/0149052 | A1 | 6/2010 | Nishio et al. | |
| 2010/0214180 | A1 | 8/2010 | Krogerus | |
| 2010/0231481 | A1 | 9/2010 | Chiang et al. | |
| 2010/0245201 | A1 | 9/2010 | Hossain et al. | |
| 2010/0271271 | A1 | 10/2010 | Wu | |
| 2011/0006953 | A1 | 1/2011 | Chiang et al. | |
| 2011/0063779 | A1 | 3/2011 | Ochi et al. | |
| 2011/0136447 | A1* | 6/2011 | Pascolini et al. | 455/90.2 |
| 2011/0183633 | A1 | 7/2011 | Ohba et al. | |
| 2011/0241949 | A1 | 10/2011 | Nickel et al. | |
| 2011/0250928 | A1* | 10/2011 | Schlub et al. | 455/550.1 |
| 2011/0291896 | A1* | 12/2011 | Pascolini et al. | 343/702 |
| 2011/0316751 | A1 | 12/2011 | Jarvis et al. | |
| 2012/0009983 | A1 | 1/2012 | Mow et al. | |
| 2012/0098720 | A1 | 4/2012 | Hill et al. | |
| 2012/0112969 | A1 | 5/2012 | Caballero et al. | |
| 2012/0112970 | A1 | 5/2012 | Caballero et al. | |
| 2012/0115553 | A1 | 5/2012 | Mahe et al. | |
| 2012/0162033 | A1 | 6/2012 | Togashi | |
| 2012/0229347 | A1 | 9/2012 | Jin et al. | |
| 2012/0231750 | A1 | 9/2012 | Jin et al. | |
| 2012/0245201 | A1 | 9/2012 | Markowitz et al. | |
| 2013/0009828 | A1 | 1/2013 | Pascolini et al. | |
| 2013/0229322 | A1 | 9/2013 | Wang | |

FOREIGN PATENT DOCUMENTS

| | | |
|---|---|---|
| CN | 101002361 | 7/2007 |
| CN | 101002362 | 7/2007 |
| CN | 101483270 | 7/2009 |
| CN | 101496224 | 7/2009 |
| CN | 101540620 | 9/2009 |
| CN | 101682119 | 3/2010 |
| CN | 201533015 | 7/2010 |
| CN | 101814649 | 8/2010 |
| CN | 101911379 | 12/2010 |
| CN | 202025842 | 11/2011 |
| CN | 102683861 | 9/2012 |
| DE | 20314836 | 11/2003 |
| DE | 10353104 | 6/2005 |
| EP | 0741433 | 11/1996 |
| EP | 1093098 | 4/2001 |
| EP | 1280230 | 1/2003 |
| EP | 1286413 | 2/2003 |
| EP | 1315238 | 5/2003 |
| EP | 1401050 | 3/2004 |
| EP | 1753082 | 4/2005 |
| EP | 1553658 | 7/2005 |
| EP | 1557903 | 7/2005 |
| EP | 1594188 | 11/2005 |
| EP | 1686651 | 8/2006 |
| EP | 1995889 | 11/2008 |
| EP | 2048739 | 4/2009 |
| EP | 2161785 | 3/2010 |
| EP | 2219265 | 8/2010 |
| EP | 2219615 | 8/2010 |
| EP | 2405534 | 1/2012 |
| GB | 921950 | 3/1963 |
| GB | 944039 | 12/1963 |
| GB | 0944039 | 12/1963 |
| GB | 2384367 | 7/2003 |
| JP | 3-502269 | 5/1991 |
| JP | 09-093029 | 4/1997 |
| JP | 09-307344 | 11/1997 |
| JP | 2001136019 | 5/2001 |
| JP | 2001185927 | 7/2001 |
| JP | 2004-48119 | 2/2004 |
| JP | 2006180077 | 7/2006 |
| JP | 2009049455 | 3/2009 |
| JP | 2010147636 | 7/2010 |
| JP | 2010536246 | 11/2010 |
| JP | 4775771 | 9/2011 |
| KR | 1986000331 | 4/1986 |
| KR | 2004108759 | 12/2004 |
| KR | 10-2005-0098880 | 10/2005 |
| TW | 310084 | 7/1997 |
| TW | 200929687 | 7/2009 |
| TW | M367429 | 10/2009 |
| WO | 8905530 | 6/1989 |
| WO | 01059945 | 8/2001 |
| WO | 02078123 | 10/2002 |
| WO | 03096474 | 11/2003 |
| WO | 2004001894 | 12/2003 |
| WO | 2004102744 | 11/2004 |
| WO | 2005032130 | 4/2005 |
| WO | 2005109567 | 11/2005 |
| WO | 2006114771 | 11/2006 |
| WO | 2007012697 | 2/2007 |
| WO | 2007039667 | 4/2007 |
| WO | 2007039668 | 4/2007 |
| WO | 2008010149 | 1/2008 |
| WO | 2008013021 | 1/2008 |
| WO | 2008055039 | 5/2008 |
| WO | 2009002575 | 12/2008 |
| WO | 2009091323 | 7/2009 |
| WO | 2009145264 | 12/2009 |
| WO | 2010025023 | 3/2010 |
| WO | 2012006152 | 1/2012 |

OTHER PUBLICATIONS

Lee et al. "A Compact and Low-Profile Tunable Loop Antenna Integrated With Inductors", IEEE Antennas and Wireless Propagation Letters, vol. 7, 2008 pp. 621-624.

Menzel et al., "A Microstrip Patch Antenna with Coplanar Feed Line" IEEE Microwave and Guided Wave Letters, vol. 1, No. 11, Nov. 1991, pp. 340-342.

Terada et al., "Circularly Polarized Tunable Microstrip Patch Antenna Using an Adjustable Air Gap", Proceedings of ISAP2005, Seoul, Korea pp. 977-980.

U.S. Appl. No. 60/833,587, filed Jan. 5, 2007, Hobson et al.

* cited by examiner

ANTENNA WITH SWITCHABLE INDUCTOR LOW-BAND TUNING

BACKGROUND

This relates generally to electronic devices, and more particularly, to antennas for electronic devices with wireless communications circuitry.

Electronic devices such as portable computers and cellular telephones are often provided with wireless communications capabilities. For example, electronic devices may use long-range wireless communications circuitry such as cellular telephone circuitry to communicate using cellular telephone bands. Electronic devices may use short-range wireless communications circuitry such as wireless local area network communications circuitry to handle communications with nearby equipment. Electronic devices may also be provided with satellite navigation system receivers and other wireless circuitry.

To satisfy consumer demand for small form factor wireless devices, manufacturers are continually striving to implement wireless communications circuitry such as antenna components using compact structures. At the same time, it may be desirable to include conductive structures in an electronic device such as metal device housing components. Because conductive structures can affect radio-frequency performance, care must be taken when incorporating antennas into an electronic device that includes conductive structures. Moreover, care must be taken to ensure that the antennas and wireless circuitry in a device are able to exhibit satisfactory performance over a range of operating frequencies.

It would therefore be desirable to be able to provide improved wireless communications circuitry for wireless electronic devices.

SUMMARY

Electronic devices may be provided that contain wireless communications circuitry. The wireless communications circuitry may include radio-frequency transceiver circuitry and antennas. An antenna may be formed from an antenna resonating element arm and an antenna ground. The antenna resonating element arm may be formed from a segment of a peripheral conductive housing member in an electronic device.

The antenna resonating element arm may have a shorter portion that resonates at higher communications band frequencies and a longer portion that resonates at lower communications band frequencies. A short circuit branch may be coupled between the shorter portion of the antenna resonating element arm and the antenna ground. A series-connected inductor and switch may be coupled between the longer portion of the antenna resonating element arm and the antenna ground. An antenna feed branch may be coupled between the antenna resonating element arm and the antenna ground at a location along the antenna resonating element arm that is between the short circuit branch and the series-connected inductor and switch.

The switch may be adjusted to configure the antenna to resonate at different frequencies. When the switch is closed, the antenna may be configured to cover a higher portion of the lower communications bands and the higher communications band. When the switch is open, the antenna may be configured to cover a lower portion of the lower communications bands and the higher communications band. Control circuitry within an electronic device may adjust the switch in real time so that the antenna covers desired frequencies of operation.

Further features of the invention, its nature and various advantages will be more apparent from the accompanying drawings and the following detailed description of the preferred embodiments.

DETAILED DESCRIPTION

Figure 1:
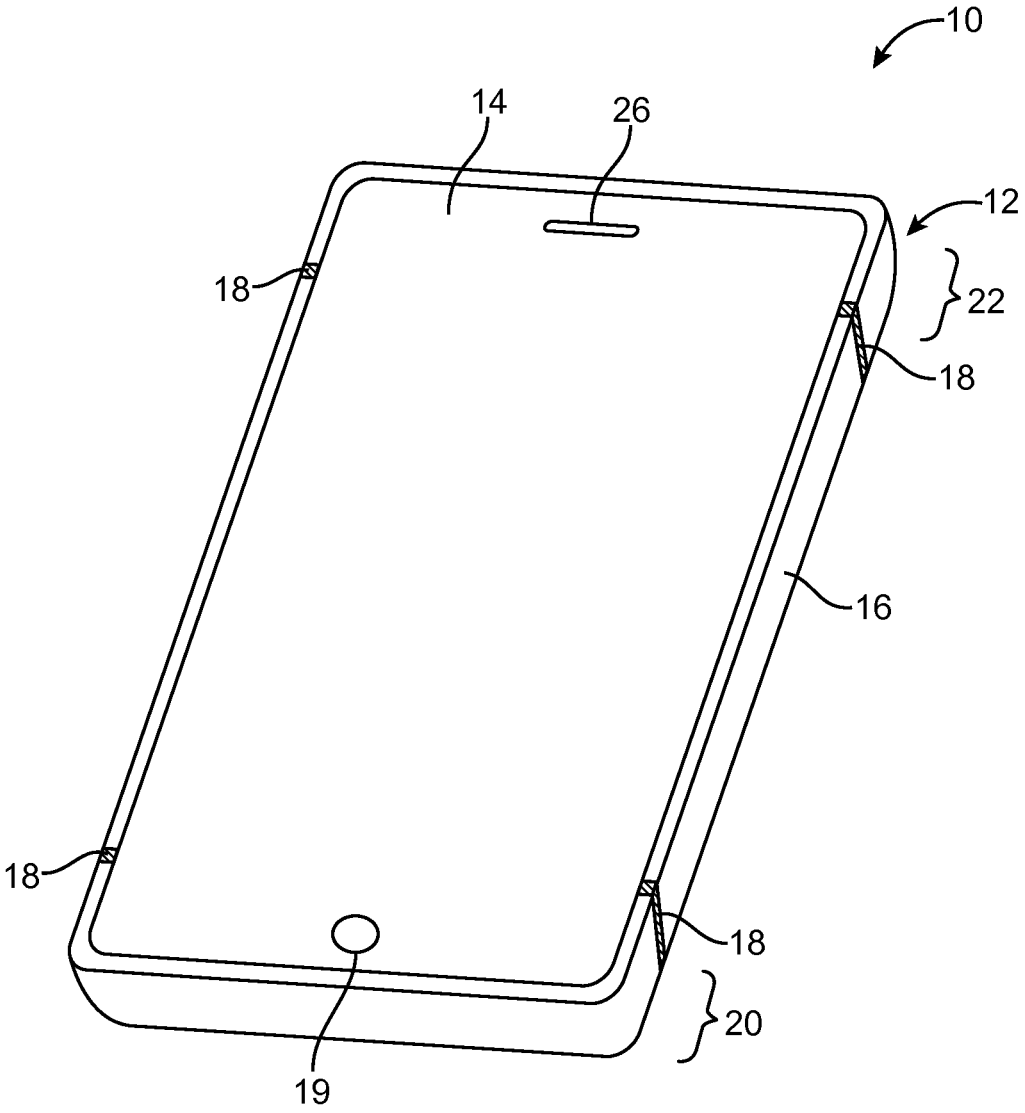
FIG. 1 is a perspective view of an illustrative electronic device with wireless communications circuitry in accordance with an embodiment of the present invention.

Electronic devices such as electronic device 10 of FIG. 1 may be provided with wireless communications circuitry. The wireless communications circuitry may be used to support wireless communications in multiple wireless communications bands. The wireless communications circuitry may include one or more antennas.

The antennas can include loop antennas, inverted-F antennas, strip antennas, planar inverted-F antennas, slot antennas, hybrid antennas that include antenna structures of more than one type, or other suitable antennas. Conductive structures for the antennas may, if desired, be formed from conductive electronic device structures. The conductive electronic device structures may include conductive housing structures. The housing structures may include a peripheral conductive member that runs around the periphery of an electronic device. The peripheral conductive member may serve as a bezel for a planar structure such as a display, may serve as sidewall structures for a device housing, and/or may form other housing structures. Gaps in the peripheral conductive member may be associated with the antennas.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a cellular telephone, or a media player. Device 10 may also be a television, a set-top box, a desktop computer, a computer monitor into which a computer has been integrated, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

Device 10 may, if desired, have a display such as display 14. Display 14 may, for example, be a touch screen that incorporates capacitive touch electrodes. Display 14 may include image pixels formed from light-emitting diodes (LEDs), organic LEDs (OLEDs), plasma cells, electrowetting pixels, electrophoretic pixels, liquid crystal display (LCD) components, or other suitable image pixel structures. A cover glass layer may cover the surface of display 14. Buttons such as button 19 may pass through openings in the cover glass. The cover glass may also have other openings such as an opening for speaker port 26.

Housing 12 may include a peripheral member such as member 16. Member 16 may run around the periphery of device 10 and display 14. In configurations in which device 10 and display 14 have a rectangular shape, member 16 may have a rectangular ring shape (as an example). Member 16 or part of member 16 may serve as a bezel for display 14 (e.g., a cosmetic trim that surrounds all four sides of display 14 and/or helps hold display 14 to device 10). Member 16 may also, if desired, form sidewall structures for device 10 (e.g., by forming a metal band with vertical sidewalls surrounding the periphery of device 10, etc.).

Member 16 may be formed of a conductive material and may therefore sometimes be referred to as a peripheral conductive member, peripheral conductive housing member, or conductive housing structures. Member 16 may be formed from a metal such as stainless steel, aluminum, or other suitable materials. One, two, or more than two separate structures (e.g., segments) may be used in forming member 16.

It is not necessary for member 16 to have a uniform cross-section. For example, the top portion of member 16 may, if desired, have an inwardly protruding lip that helps hold display 14 in place. If desired, the bottom portion of member 16 may also have an enlarged lip (e.g., in the plane of the rear surface of device 10). In the example of FIG. 1, member 16 has substantially straight vertical sidewalls. This is merely illustrative. The sidewalls of member 16 may be curved or may have any other suitable shape. In some configurations (e.g., when member 16 serves as a bezel for display 14), member 16 may run around the lip of housing 12 (i.e., member 16 may cover only the edge of housing 12 that surrounds display 14 and not the rear edge of housing 12 of the sidewalls of housing 12).

Display 14 may include conductive structures such as an array of capacitive electrodes, conductive lines for addressing pixel elements, driver circuits, etc. Housing 12 may include internal structures such as metal frame members, a planar housing member (sometimes referred to as a midplate) that spans the walls of housing 12 (i.e., a substantially rectangular member that is welded or otherwise connected between opposing sides of member 16), printed circuit boards, and other internal conductive structures. These conductive structures may be located in the center of housing 12 under display 14 (as an example).

In regions 22 and 20, openings may be formed within the conductive structures of device 10 (e.g., between peripheral conductive member 16 and opposing conductive structures such as conductive housing structures, a conductive ground plane associated with a printed circuit board, and conductive electrical components in device 10). These openings may be filled with air, plastic, and other dielectrics. Conductive housing structures and other conductive structures in device 10 may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, or may otherwise serve as part of antenna structures formed in regions 20 and 22.

In general, device 10 may include any suitable number of antennas (e.g., one or more, two or more, three or more, four or more, etc.). The antennas in device 10 may be located at opposing first and second ends of an elongated device housing, along one or more edges of a device housing, in the center of a device housing, in other suitable locations, or in one or more of such locations. The arrangement of FIG. 1 is merely illustrative.

Portions of member 16 may be provided with gap structures. For example, member 16 may be provided with one or more gaps such as gaps 18, as shown in FIG. 1. The gaps may be filled with dielectric such as polymer, ceramic, glass, air, other dielectric materials, or combinations of these materials. Gaps 18 may divide member 16 into one or more peripheral conductive member segments. There may be, for example, two segments of member 16 (e.g., in an arrangement with two gaps), three segments of member 16 (e.g., in an arrangement with three gaps), four segments of member 16 (e.g., in an arrangement with four gaps, etc.). The segments of peripheral conductive member 16 that are formed in this way may form parts of antennas in device 10.

In a typical scenario, device 10 may have upper and lower antennas (as an example). An upper antenna may, for example, be formed at the upper end of device 10 in region 22. A lower antenna may, for example, be formed at the lower end of device 10 in region 20. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, etc.

Figure 2:
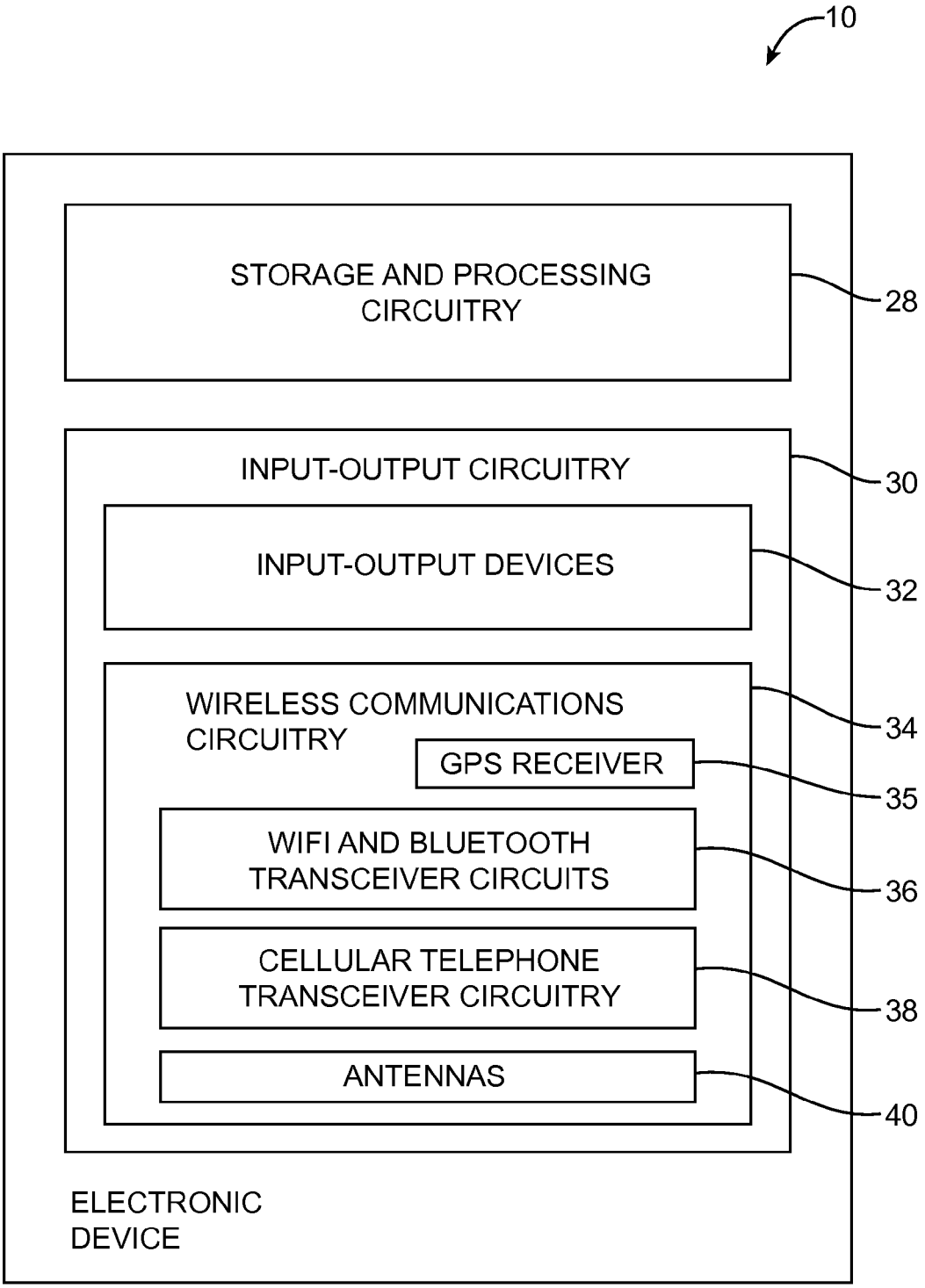
FIG. 2 is a schematic diagram of an illustrative electronic device with wireless communications circuitry in accordance with an embodiment of the present invention.

A schematic diagram of an illustrative configuration that may be used for electronic device 10 is shown in FIG. 2. As shown in FIG. 2, electronic device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. The processing circuitry may be based on one or more microprocessors, microcontrollers, digital signal processors, baseband processors, power management units, audio codec chips, application specific integrated circuits, etc.

Storage and processing circuitry 28 may be used to run software on device 10, such as internet browsing applications, voice-over-internet-protocol (VoIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, etc.

Circuitry 28 may be configured to implement control algorithms that control the use of antennas in device 10. For example, circuitry 28 may perform signal quality monitoring operations, sensor monitoring operations, and other data gathering operations and may, in response to the gathered data and information on which communications bands are to be used in device 10, control which antenna structures within device 10 are being used to receive and process data and/or may adjust one or more switches, tunable elements, or other adjustable circuits in device 10 to adjust antenna performance. As an example, circuitry 28 may control which of two or more antennas is being used to receive incoming radio-frequency signals, may control which of two or more antennas is being used to transmit radio-frequency signals, may control the process of routing incoming data streams over two or more antennas in device 10 in parallel, may tune an antenna to cover a desired communications band, etc. In performing these control operations, circuitry 28 may open and close switches, may turn on and off receivers and transmitters, may adjust impedance matching circuits, may configure switches in front-end-module (FEM) radio-frequency circuits that are interposed between radio-frequency transceiver circuitry and antenna structures (e.g., filtering and switching circuits used for impedance matching and signal routing), may adjust switches, tunable circuits, and other adjustable circuit elements that are formed as part of an antenna or that are coupled to an antenna or a signal path associated with an antenna, and may otherwise control and adjust the components of device 10.

Input-output circuitry 30 may be used to allow data to be supplied to device 10 and to allow data to be provided from device 10 to external devices. Input-output circuitry 30 may include input-output devices 32. Input-output devices 32 may include touch screens, buttons, joysticks, click wheels, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 32 and may receive status information and other output from device 10 using the output resources of input-output devices 32.

Wireless communications circuitry 34 may include radio-frequency (RF) transceiver circuitry formed from one or more integrated circuits, power amplifier circuitry, low-noise input amplifiers, passive RF components, one or more antennas, and other circuitry for handling RF wireless signals. Wireless signals can also be sent using light (e.g., using infrared communications).

Wireless communications circuitry 34 may include satellite navigation system receiver circuitry such as Global Positioning System (GPS) receiver circuitry 35 (e.g., for receiving satellite positioning signals at 1575 MHz) or satellite navigation system receiver circuitry associated with other satellite navigation systems. Transceiver circuitry 36 may handle wireless local area network communications. For example, transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in cellular telephone bands such as bands in frequency ranges of about 700 MHz to about 2200 MHz or bands at higher or lower frequencies. Wireless communications circuitry 34 can include circuitry for other short-range and long-range wireless links if desired. For example, wireless communications circuitry 34 may include wireless circuitry for receiving radio and television signals, paging circuits, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include one or more antennas 40. Antennas 40 may be formed using any suitable antenna types. For example, antennas 40 may include antennas with resonating elements that are formed from loop antenna structure, patch antenna structures, inverted-F antenna structures, closed and open slot antenna structures, planar inverted-F antenna structures, helical antenna structures, strip antennas, monopoles, dipoles, hybrids of these designs, etc. Different types of antennas may be used for different bands and combinations of bands. For example, one type of antenna may be used in forming a local wireless link antenna and another type of antenna may be used in forming a remote wireless link.

If desired, one or more of antennas 40 may be provided with tunable circuitry. The tunable circuitry may include, for example, switching circuitry based on one or more switches. The switching circuitry may, for example, include a switch that can be placed in an open or closed position. When control circuitry 28 of device 10 places the switch in its open position, an antenna may exhibit a first frequency response. When control circuitry 28 of device 10 places the antenna in its closed position, the antenna may exhibit a second frequency response. As an example, antenna 40 may exhibit both a low band response and a high band response. Adjustment of the state of the switch may be used to tune the low band response of the antenna without appreciably affecting the high band response. The ability to adjust the low band response of the antenna may allow the antenna to cover communications frequencies of interest.

Figure 3:
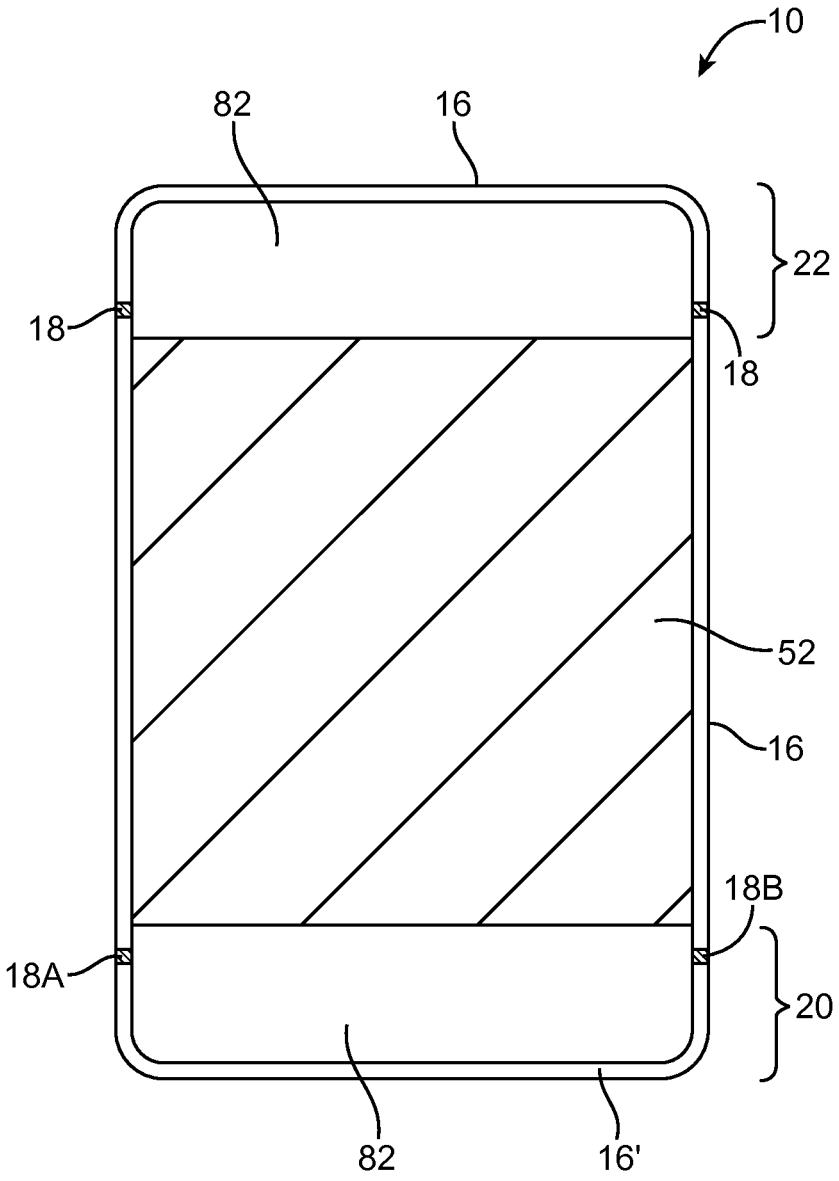
FIG. 3 is a top view of an illustrative electronic device of the type shown in FIG. 1 in which antennas may be formed using conductive housing structures such as portions of a peripheral conductive housing member in accordance with an embodiment of the present invention.

A top interior view of device 10 in a configuration in which device 10 has a peripheral conductive housing member such as housing member 16 of FIG. 1 with one or more gaps 18 is shown in FIG. 3. As shown in FIG. 3, device 10 may have an antenna ground plane such as antenna ground plane 52. Ground plane 52 may be formed from traces on printed circuit boards (e.g., rigid printed circuit boards and flexible printed circuit boards), from conductive planar support structures in the interior of device 10, from conductive structures that form exterior parts of housing 12, from conductive structures that are part of one or more electrical components in device 10 (e.g., parts of connectors, switches, cameras, speakers, microphones, displays, buttons, etc.), or other conductive device structures. Gaps such as gaps 82 may be filled with air, plastic, or other dielectric.

One or more segments of peripheral conductive member 16 may serve as antenna resonating elements such as antenna resonating element 50 of FIG. 3. For example, the uppermost segment of peripheral conductive member 16 in region 22 may serve as an antenna resonating element for an upper antenna in device 10 and the lowermost segment of peripheral conductive member 16 in region 20 (i.e., segment 16', which extends between gap 18A and gap 18B) may serve as an antenna resonating element for a lower antenna in device 10. The conductive materials of peripheral conductive member 16, the conductive materials of ground plane 52, and dielectric openings 82 (and gaps 18) may be used in forming one or more antennas in device 10 such as an upper antenna in region 22 and a lower antenna in region 20. Configurations in which an antenna in lower region 20 is implemented using a tunable frequency response configuration are sometimes described herein as an example.

Figure 4:
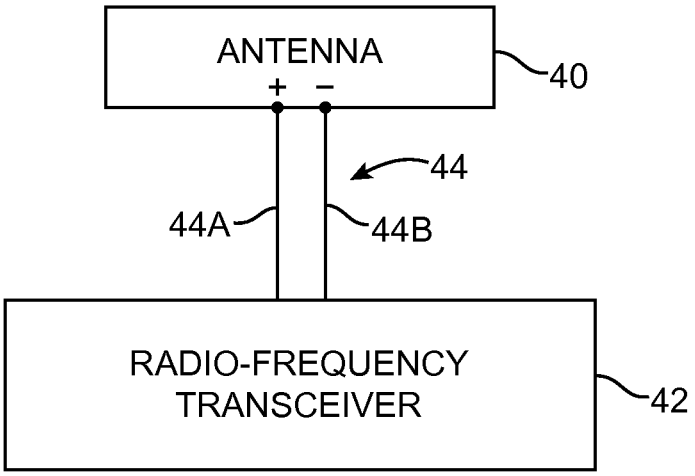
FIG. 4 is a circuit diagram showing how an antenna in the electronic device of FIG. 1 may be coupled to radio-frequency transceiver circuitry in accordance with an embodiment of the present invention.

FIG. 4 is a diagram showing how a radio-frequency signal path such as path 44 may be used to convey radio-frequency signals between antenna 40 and radio-frequency transceiver 42. Antenna 40 may be one of antennas 40 of FIG. 2. Radio-frequency transceiver 42 may be a receiver and/or transmitter in wireless communications circuitry 34 (FIG. 3) such as receiver 35, wireless local area network transceiver 36 (e.g., a transceiver operating at 2.4 GHz, 5 GHz, 60 GHz, or other suitable frequency), cellular telephone transceiver 38, or other radio-frequency transceiver circuitry for receiving and/or transmitting radio-frequency signals.

Signal path 44 may include one or more transmission lines such as one or more segments of coaxial cable, one or more segments of microstrip transmission line, one or more segments of stripline transmission line, or other transmission line structures. Signal path 44 may include a positive conductor such as positive signal line 44A and may include a ground conductor such as ground signal line 44B. Antenna 40 may have an antenna feed with a positive antenna feed terminal (+) and a ground antenna feed terminal (−). If desired, circuitry such as filters, impedance matching circuits, switches, amplifiers, and other circuits may be interposed within path 44.

Figure 5:
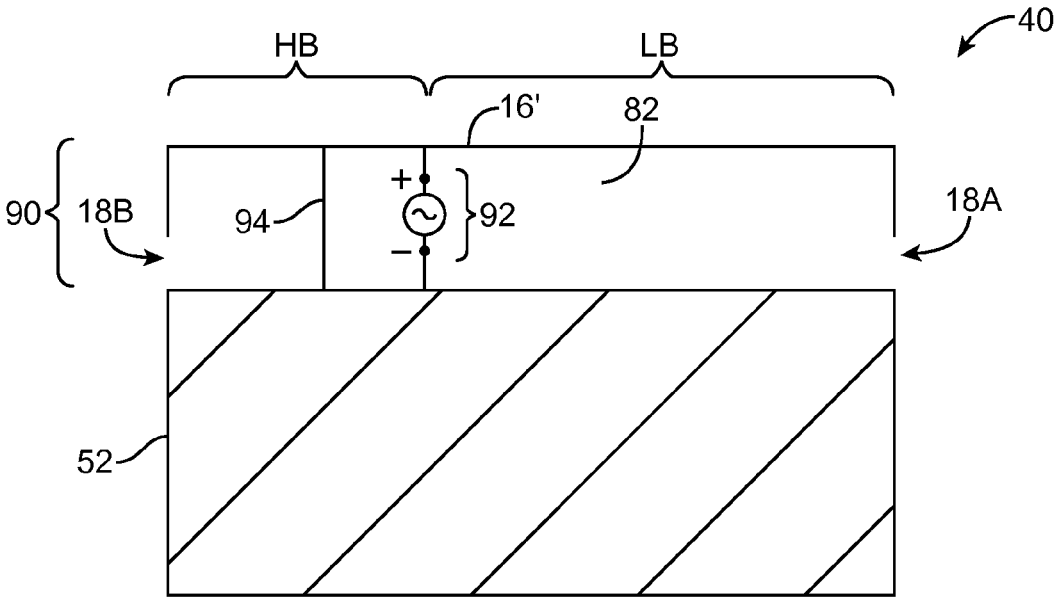
FIG. 5 is a diagram of an illustrative antenna having an antenna resonating element of the type that may be formed form a segment of a peripheral conductive housing member and that has portions that support communications in low and high bands in accordance with an embodiment of the present invention.

FIG. 5 is a diagram showing how structures such as peripheral conductive member segment 16' of FIG. 3 may be used in forming antenna 40. In the illustrative configuration of FIG. 5, antenna 40 includes antenna resonating element 90 and antenna ground 52. Antenna resonating element may have a main resonating element arm formed from peripheral conductive member 16' (e.g., a segment of peripheral conductive member 16 of FIG. 1). Gaps such as gaps 18A and 18B may be interposed between the ends of resonating element arm 16' and ground 52. Short circuit branch 94 may be coupled between arm 16' and ground 52. Antenna feed branch 92 may be coupled between arm 16' and ground 52 in parallel with short circuit branch 94. Antenna feed branch 92 may include a positive antenna feed terminal (+) and a ground antenna feed terminal (−). As described in connection with FIG. 4, lines 44A and 44B in signal path 44 may be respectively coupled to terminals (+) and (−) in antenna feed 92.

Resonating element arm 16' may have a longer portion (LB) that is associated with a low band resonance and that can be used for handling low band wireless communications. Resonating element arm 16' may also have a shorter portion (HB) that is associated with a high band resonance and that can be used for handling high band wireless communications. The low band portion of arm 16' may, for example, be used in handling signals at frequencies of 700 MHz to 960 MHz (as an example). The high band portion of arm 16' may, for example, be used in handling signals at frequencies of 1710 MHz to 2200 MHz (as an example). These are merely illustrative low band and high band frequencies of operation for antenna 40. Antenna 40 may be configured to handle any suitable frequencies of interest for device 10.

Figure 6A:
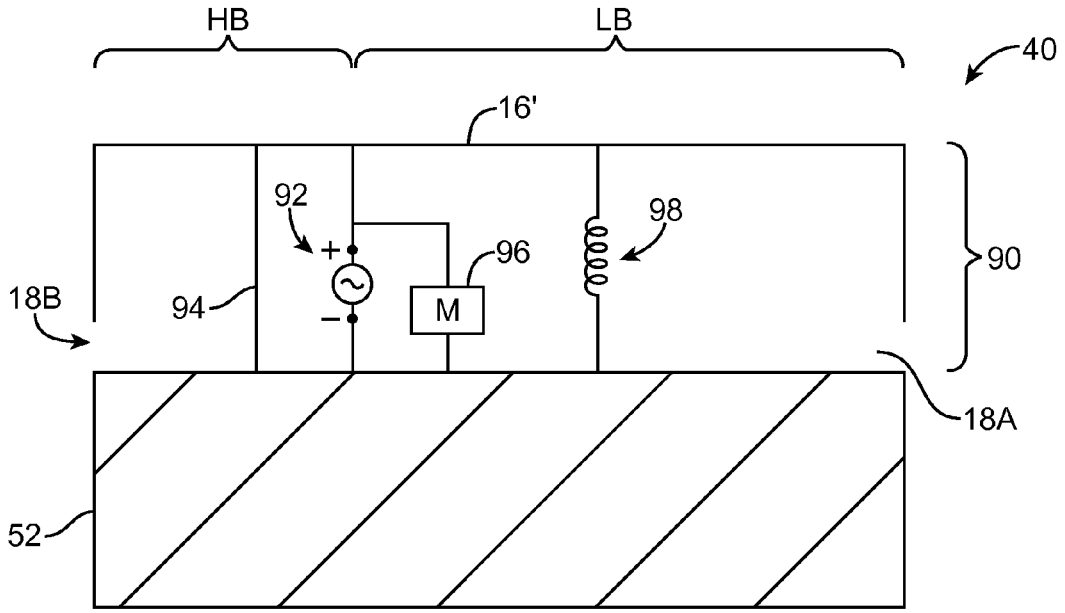
FIG. 6A is a diagram of an illustrative antenna of the type shown in FIG. 5 that has been provided with a matching circuit and in which a main resonating element arm has been coupled to ground using an inductor in accordance with an embodiment of the present invention.

FIG. 6A shows how antenna 40 may be provided with an impedance matching circuit such as impedance matching circuit 96. Matching circuit 96 may be formed from a network or one or more electrical components (e.g., resistors, capacitors, and/or inductors) and may be configured so that antenna 40 exhibits a desired frequency response (e.g., so that antenna 40 covers desired communications bands of interest). As an example, matching circuit 96 may include an inductor coupled in parallel with feed 92 and/or additional electrical components.

As shown in FIG. 6A, impedance matching circuit 96 may be coupled between antenna resonating element arm 16' and antenna ground 52 in parallel with antenna feed branch 92. Short circuit branch 94 may be coupled in parallel with feed branch 92 between resonating element arm 16' and ground (e.g., on the high band side of feed 92, which is to the left of feed 92 in the illustrative configuration of FIG. 6A). Shunt inductor 98 may also be coupled in parallel with antenna feed branch 92 between arm 16' and ground 52 (e.g., on the low band side of feed 92, which is to the right of feed 92 in the illustrative configuration of FIG. 6A).

Figure 6B:
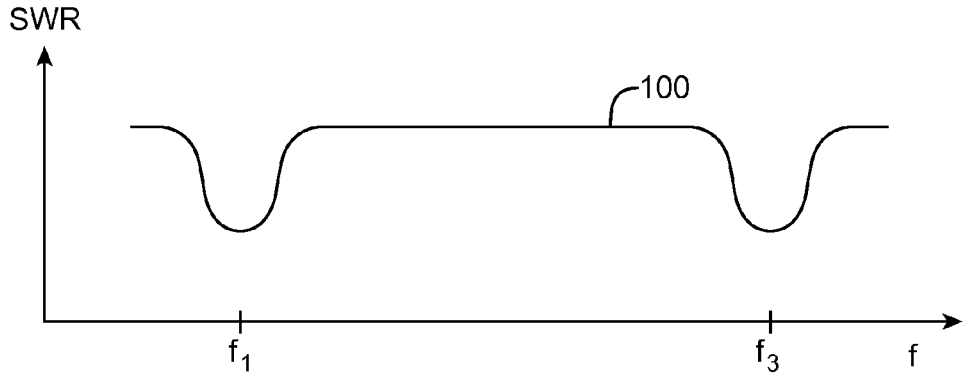
FIG. 6B is a graph in which antenna performance for an antenna configuration of the type shown in FIG. 6A has been plotted as a function of frequency in accordance with an embodiment of the present invention.

The antenna configuration of FIG. 6A may be characterized by a performance curve such as standing-wave-ratio versus frequency curve 100 of FIG. 6B. As shown in FIG. 6B, antenna 40 of FIG. 6A may be characterized by a low band resonance centered at a frequency f1 (e.g., a resonance produced using portion LB of antenna 40 of FIG. 6A) and may be characterized by a high band resonance at frequency f3 (e.g., a resonance produced using portion HB of antenna 40 of FIG. 6A).

Figure 7A:
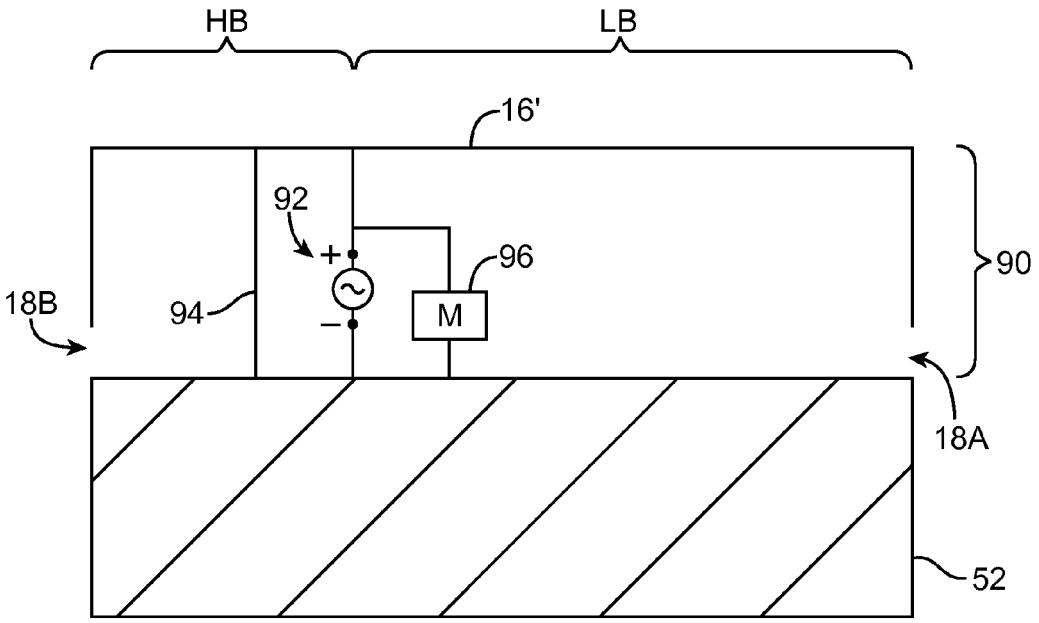
FIG. 7A is a diagram of an illustrative antenna of the type shown in FIG. 6A in which the shunt inductor has been removed in accordance with an embodiment of the present invention.
Figure 7B:
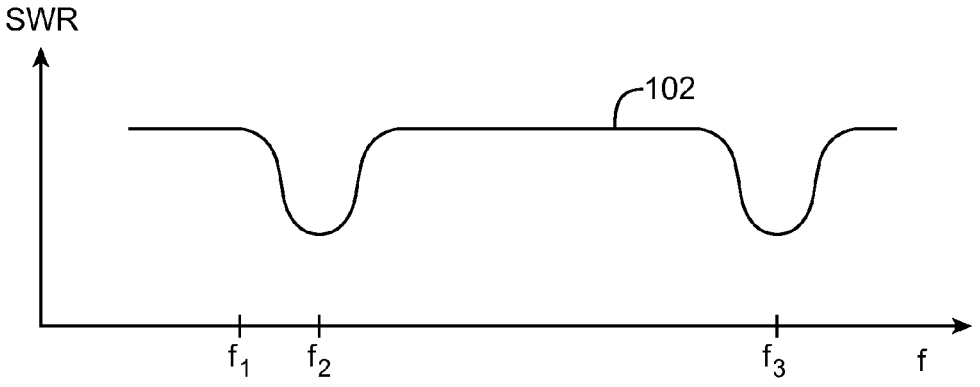
FIG. 7B is a graph in which antenna performance for an antenna configuration of the type shown in FIG. 7A has been plotted as a function of frequency in accordance with an embodiment of the present invention.

The low band resonance of curve 100 at frequency f1 may not be sufficiently wide to cover all low band frequencies of interest. FIG. 7A shows how antenna 40 of FIG. 6A may be modified so that the low band resonance cover a different set of low band frequencies. In the illustrative configuration of FIG. 7A, shunt inductor 98 of FIG. 6A has been removed. The antenna configuration of FIG. 7A may be characterized by a performance curve such as standing-wave-ratio versus frequency curve 102 of FIG. 7B. As shown in FIG. 7B, antenna 40 of FIG. 7A may be characterized by a low band resonance centered at a frequency f2 (e.g., a resonance produced using portion LB of antenna 40 of FIG. 6A that is higher in frequency than frequency f1). The high band resonance of antenna 40 of FIG. 7A may cover the same high band frequencies as antenna 40 of FIG. 6A (as an example).

Figure 8A:
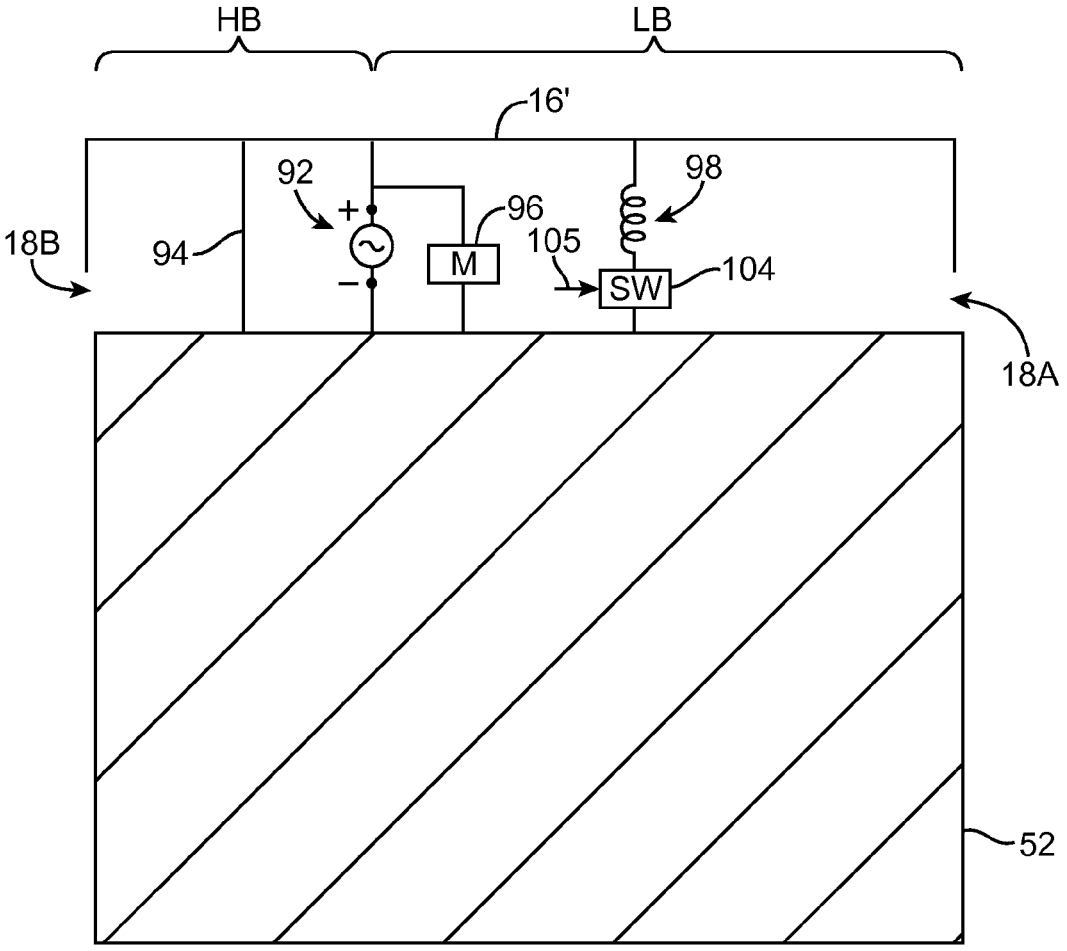
FIG. 8A is a diagram of an illustrative dual-band antenna having a tunable low band response in accordance with an embodiment of the present invention.

It may be desirable to cover both the low frequency band at frequency f1 (FIG. 6B) and the low frequency band at frequency f2 (FIG. 7B) in device 10. This can be accomplished by providing antenna 40 with switching circuitry such as switch 104 of FIG. 8A. As shown in FIG. 8A, short circuit branch 94 may be coupled between antenna resonating element arm 16' and antenna ground 52 at a first location along the length of antenna resonating element arm 16'. Switch 104 and inductor 98 may be coupled in series and may be used to form an adjustable inductor circuit that is coupled between antenna resonating element arm 16' and antenna ground 52 at a second location along the length of antenna resonating element arm 16'. Antenna feed branch 92 may be coupled between antenna resonating element arm 16' and antenna ground 52 at a third location along the length of antenna resonating element arm 16' interposed between the short circuit branch at the first location and the series-connected inductor and switch and the second location.

As shown in FIG. 8A, switch 104 may be provided with control signals at control input 105 from control circuitry 28 (FIG. 2). The control signals may be adjusted in real time to control the frequency response of antenna 40. For example, when it is desired to configure antenna 40 of FIG. 8A to cover the communications band at frequency f1 of FIG. 6B, switch 104 may be placed in its closed state. When switch 104 is closed, inductor 98 will be electrically coupled between resonating element arm 16' and ground 52, so that antenna 40 of FIG. 8A will have a configuration of the type shown in FIG. 6A. When switch 104 is placed in its open state, an open circuit will be formed that electrically decouples inductor 98 from antenna 40 of FIG. 8A. With inductor 98 switched out of use in this way, antenna 40 of FIG. 8A will have a configuration of the type shown in FIG. 7A.

Figure 8B:
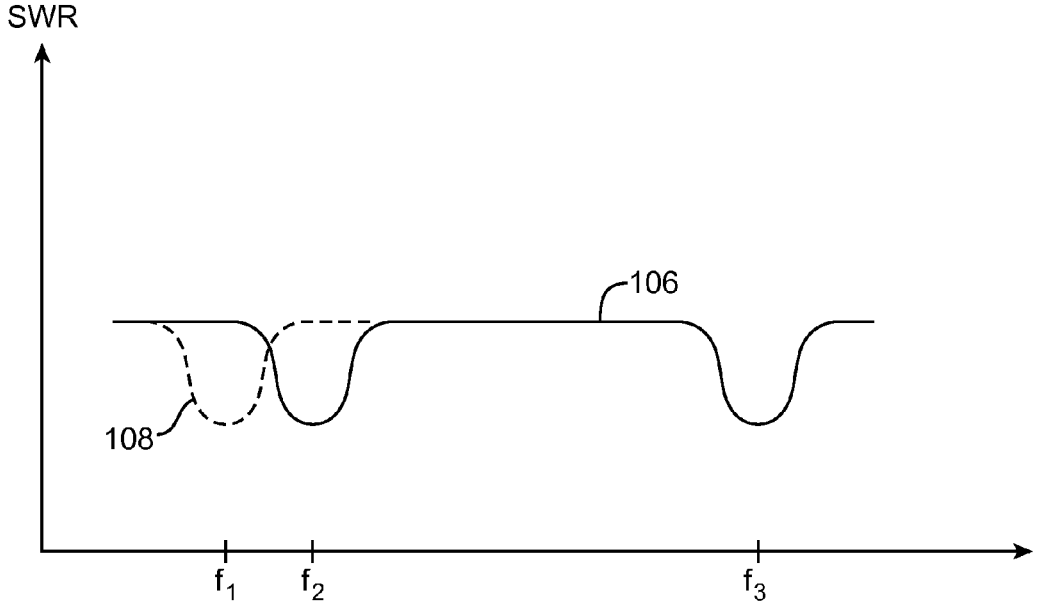
FIG. 8B is a graph in which antenna performance for an antenna configuration of the type shown in FIG. 8A has been plotted as a function of frequency showing how antenna response can be tuned by opening and closing the switch of FIG. 8A in accordance with an embodiment of the present invention.

The antenna configuration of FIG. 8A may be characterized by a performance curve such as standing-wave-ratio versus frequency curve 106 of FIG. 8B. As shown in FIG. 8B, antenna 40 of FIG. 8A may be characterized by a low band resonance centered at a frequency f1 (curve 108) when switch 104 is closed and may be characterized by a low band resonance centered at a frequency f2 (curve 106) when switch 104 is open. The high band resonance at frequency f3 may be relatively unaffected by the position of switch 104 (i.e., the high band resonance of antenna 40 of FIG. 8A may cover a communications band centered at frequency f3 when switch 104 is in its open position and when switch 104 is in its closed position).

The frequency bands associated with antenna 40 of FIGS. 8A and 8B may correspond to wireless local area network bands, satellite navigation bands, television bands, radio bands, cellular telephone bands, or other communications band of interest. For example, the communications band associated with frequency f1 may extend from about 700 to 820 MHz and may be used to handle Long Term Evolution (LTE) cellular telephone communications, the communications band associated with frequency f2 may extend from about 820 to 960 MHz and may be associated with Global System for Mobile Communications (GSM) cellular telephone communications, Universal Mobile Telecommunications System (UMTS) cellular telephone communications, and/or optional LTE cellular telephone communications, and the communications band associated with frequency f3 may extend from about 1710 to 2200 MHz and may be used in handling GSM, LTE, and/or UMTS cellular telephone communications (as examples). Other types of communications traffic may be handled using antenna 40 of FIG. 8A if desired. These are merely illustrative examples.

The foregoing is merely illustrative of the principles of this invention and various modifications can be made by those skilled in the art without departing from the scope and spirit of the invention.

What is claimed is:

1. An electronic device, comprising:

control circuitry;

an antenna having an antenna resonating element arm and an antenna ground configured to resonate in at least a first communications band and a second communications band that is higher in frequency than the first communications band, having an inductor, and having a switch, wherein the inductor and switch are coupled in series between antenna resonating element arm and the antenna ground, the inductor contacts the antenna resonating element, the switch is configured to switch between an open state and a closed state in response to control signals from the control circuitry, the antenna is configured to resonate in a lower frequency portion of the first communications band and at a frequency in the second communications band in response to placing the switch in the closed state, and the antenna is configured to resonate in a higher frequency portion of the first communications band and at the frequency in the second communications band in response to placing the switch in the open state; and a housing containing conductive structures that form the antenna ground for the antenna and having a peripheral conductive member that runs around at least some edges of the housing, wherein a segment of the peripheral conductive member forms the antenna resonating element arm for the antenna, the segment is separated from the antenna ground by first and second dielectric gaps, and the first and second dielectric gaps are formed on opposing external surfaces of the electronic device.

2. The electronic device defined in claim 1 wherein the antenna comprises an antenna feed branch coupled between the segment of the peripheral conductive member and the antenna ground.

3. The electronic device defined in claim 2 further comprising a cellular telephone transceiver coupled to the antenna at the antenna feed branch.

4. The electronic device defined in claim 3 further comprising a short circuit branch coupled between the segment of the peripheral conductive member and the antenna ground.

5. The electronic device defined in claim 4 wherein the antenna feed branch is interposed between the short circuit branch and the inductor and switch that are coupled in series.

6. The electronic device defined in claim 1 wherein the antenna resonating element arm has a longer portion that resonates in the first communications band and a shorter portion that resonates in the second communications band.

7. The electronic device defined in claim 1, wherein the second communications band is centered at the frequency in the second communications band.

8. The electronic device defined in claim 7, wherein the second communications band comprises a Long Term Evolution cellular telephone band extending from approximately 1710 MHz to 2200 MHz and the first communications band comprises a Long Term Evolution cellular telephone band extending from approximately 700 MHz to 960 MHz.

9. The electronic device defined in claim 8, wherein the lower frequency portion of the first communications band extends from approximately 700 MHz to 820 MHz and wherein the higher frequency portion of the first communications band extends from approximately 820 MHz to 960 MHz.

10. The electronic device defined in claim 1, further comprising third and fourth dielectric gaps in the peripheral conductive member, wherein the third dielectric gap is formed on a first of the opposing external surfaces of the electronic device and the fourth dielectric gap is formed on a second of the opposing external surfaces of the electronic device.

11. The electronic device defined in claim 10, further comprising:

an additional antenna having an additional antenna resonating element arm, wherein an additional segment of the peripheral conductive member forms the additional resonating element arm for the additional antenna, and the additional antenna is separated from the antenna ground by the third and fourth dielectric gaps.

12. The electronic device defined in claim 11, wherein the segment of the peripheral conductive member forms a third external surface of the electronic device, the additional segment of the peripheral conductive member forms a fourth external surface of the electronic device, and the third and fourth external surfaces extend substantially perpendicular to the first and second opposing external surfaces of the electronic device.

13. An antenna, comprising:

an antenna resonating element arm that comprises a segment of a peripheral conductive member of an electronic device housing;

an antenna ground, wherein the segment of the peripheral conductive member is separated from the antenna ground by first and second dielectric gaps formed at opposing external surfaces of the electronic device housing;

a series-connected inductor and switch coupled between the resonating element arm and the antenna ground, wherein the inductor is connected in series between the switch and the resonating element arm and contacts the resonating element arm;

a short circuit branch coupled between the antenna resonating element arm and the antenna ground;

an antenna feed coupled between the antenna resonating element arm and the antenna ground at a location along the antenna resonating element arm that is between the short circuit branch and the series-connected inductor and switch, wherein the antenna is configured to resonate in a lower frequency portion of a first communications band and at a frequency in a second communications band that is at higher frequencies than the first communications band in response to placing the switch in a closed state and the antenna is configured to resonate in a higher frequency portion of the first communications band and at the frequency in the second communications band in response to placing the switch in an open state; and an impedance matching circuit coupled in parallel with the antenna feed and in parallel with the series-connected inductor and switch, wherein a first terminal of the impedance matching circuit is coupled to the segment of the peripheral conductive member and a second terminal of the impedance matching circuit is coupled to the antenna ground.

14. The antenna defined in claim 13 wherein the antenna resonating element arm is configured to handle cellular telephone signals.

15. The electronic device defined in claim 14 wherein the antenna resonating element arm has a longer portion that resonates in the first communications band and a shorter portion that resonates in the second communications band.

16. The electronic device defined in claim 13 wherein the antenna resonating element arm has a longer portion that resonates in the first communications band and a shorter portion that resonates in the second communications band.

17. An antenna, comprising:

an antenna resonating element arm that has a longer portion that resonates in a first communications band and a shorter portion that resonates in a second communications band that is associated with higher frequencies than the first communications band, wherein the antenna resonating element arm comprises a segment of a peripheral conductive member of a housing for an electronic device and the segment is located between first and second dielectric gaps in the peripheral conductive member, the first and second dielectric gaps being formed at opposing exterior surfaces of the electronic device;

an antenna ground;

a series-connected inductor and switch coupled between the resonating element arm and the antenna ground;

a short circuit branch coupled between the antenna resonating element arm and the antenna ground; and an antenna feed coupled between the segment and the antenna ground, wherein the longer and shorter portions of the antenna resonating element arm extend from opposing sides of the antenna feed in a common plane.

18. The antenna defined in claim 17 wherein the antenna feed is coupled between the antenna resonating element and the antenna ground at a location along the antenna resonating element arm that is between the short circuit branch and the series-connected inductor and switch.

19. The antenna defined in claim 18 wherein the short circuit branch is coupled between the shorter portion of the antenna resonating element and the antenna ground.

20. The antenna defined in claim 19 wherein the series-connected inductor and switch are coupled between the longer portion of the antenna resonating element arm and the antenna ground.

21. The antenna defined in claim 17, wherein the first dielectric gap is formed at a first end of the shorter portion and the second dielectric gap is formed at a first end of the longer portion, and the antenna feed contacts the segment of the peripheral conductive member at a second end of the longer portion that opposes the first end of the longer portion and at a second end of the shorter portion that opposes the first end of the shorter portion.

22. The antenna defined in claim 21, wherein the shorter portion comprises a perpendicular bend and the longer portion comprises an additional perpendicular bend, wherein the short circuit branch is coupled to the segment of the peripheral conductive member at a location between the perpendicular bend of the shorter portion and the antenna feed, and wherein the series-connected inductor and switch are coupled to the segment of the peripheral conductive member at a location between the perpendicular bend of the longer portion and the antenna feed.

23. The antenna defined in claim 17, wherein the electronic device has a length, a width that is less than the length, and a height that is less than the width, and the first and second dielectric gaps extend across the height of the electronic device from a rear face to a front face of the electronic device.

24. The antenna defined in claim 17, wherein the segment of the peripheral conductive member comprises a first portion adjacent to the first dielectric gap, a second portion adjacent to the second dielectric gap, and a third portion extending between the first and second portions, the third portion extending substantially perpendicular to the first and second portions.

25. The antenna defined in claim 24, wherein the third portion is longer than the first and second portions.

26. The antenna defined in claim 24, wherein the antenna comprises an inverted-F antenna.

* * * * *